US007923932B2

(12) United States Patent
Lapatovich et al.

(10) Patent No.: US 7,923,932 B2
(45) Date of Patent: Apr. 12, 2011

(54) SHORT METAL VAPOR CERAMIC LAMP

(75) Inventors: Walter P. Lapatovich, Boxford, MA (US); James Avallon, Beverly, MA (US); John Selverian, North Reading, MA (US)

(73) Assignee: Osram Sylvania Inc., Danvers, MA (US)

( * ) Notice: Subject to any disclaimer, the term of this patent is extended or adjusted under 35 U.S.C. 154(b) by 257 days.

(21) Appl. No.: 11/895,581

(22) Filed: Aug. 27, 2007

(65) Prior Publication Data

US 2009/0058300 A1 Mar. 5, 2009

(51) Int. Cl.
*H01J 61/12* (2006.01)

(52) U.S. Cl. ..... 313/637; 313/623; 313/624; 313/625

(58) Field of Classification Search ..... 313/637, 313/623–625, 634–636, 493, 318.12, 570; 118/50; 445/26, 27

See application file for complete search history.

(56) References Cited

U.S. PATENT DOCUMENTS

| | | | | |
|---|---|---|---|---|
| 4,334,628 | A * | 6/1982 | Buhrer et al. | 220/2.1 R |
| 4,366,410 | A | 12/1982 | Buhrer | |
| 5,861,714 | A * | 1/1999 | Wei et al. | 313/625 |
| 6,469,428 | B1 | 10/2002 | Thiel | |
| 6,498,429 | B1 * | 12/2002 | Sneider et al. | 313/576 |
| 7,245,081 | B2 * | 7/2007 | Ashida et al. | 313/637 |
| 2003/0189408 | A1 * | 10/2003 | Lapatovich et al. | 313/637 |
| 2005/0168150 | A1 * | 8/2005 | Callahan et al. | 313/637 |
| 2006/0279218 | A1 * | 12/2006 | Uemura et al. | 313/636 |
| 2007/0085478 | A1 | 4/2007 | Dakin | |
| 2009/0134796 | A1 * | 5/2009 | Huttinger et al. | 313/623 |

FOREIGN PATENT DOCUMENTS

| | | |
|---|---|---|
| WO | WO 2006/046172 A1 | 5/2006 |
| WO | WO 2006/077516 | 7/2006 |
| WO | WO 2007/017714 A1 | 2/2007 |

* cited by examiner

*Primary Examiner* — Bumsuk Won
*Assistant Examiner* — Elmito Breval
(74) *Attorney, Agent, or Firm* — William E. Meyer; Robert F. Clark

(57) ABSTRACT

A high intensity arc discharge lamp having a short metal seal plug running hotter than typical of capillary seals, enables a lamp with a metal fill to achieve a vapor pressure higher than the one set by the cold spot temperature typically of a capillary seal lamp. Corrosive fill materials, such as halogens are excluded. Zinc may be used to in starting the lamp.

5 Claims, 8 Drawing Sheets

SHORT METAL VAPOR CERAMIC LAMP

CROSS-REFERENCE TO RELATED APPLICATIONS

Not Applicable

BACKGROUND OF THE INVENTION

1. Field of the Invention

The invention relates to electric lamps and particularly to high intensity arc discharge electric lamps. More particularly the invention is concerned with ceramic high intensity arc discharge lamps with pure metal fills.

2. Description of the Related Art Including Information Disclosed Under 37 CFR 1.97 and 1.98

Ceramic high intensity arc discharge lamps are a good source of intense white light, and are convenient for projectors and other beam producing fixtures. They are commonly made with a ceramic main body that may be cylindrical or bulbous and have two axially extending elongated capillaries supporting the sealed leads. Capillaries typically have a length to diameter ratio of 10 or more. The long capillaries provide a large temperature gradient between the hot interior end near the main body and the cooler exterior end near the capillary tip. A metal electrode, typically an extended rod assembly of a tungsten electrode tip, an extension section which may be molybdenum or cermet and a sealing section commonly niobium, may then be frit sealed along the niobium portion to the cooler end of the capillary. The elongated capillaries necessarily form axially long lamps that are difficult to position in small volume fixtures such as small projectors. There is then a need for ceramic discharge lamp without capillaries or capillary seals.

In operation, the seal temperatures of an HID lamp must be maintained below the melting temperature of the weakest element. Typically the weakest element is the frit seal. The frit is kept cool by extending the seal away from the main ceramic body by the long capillary. The maximum operating temperature of the frit frequently sets the cold spot temperature of the lamp, thereby limiting the materials that can be vaporized in the lamp during operation. There is then a need for a lamp with a higher operating seal temperature.

Heat flow along the capillary is thermally resisted by using a narrow cross section and by radiating heat, convectively cooling or otherwise loosing heat over the extended capillary length. There are several problems with cooling the electrode over an extended capillary to preserve the frit. The first is the capillaries extend the size of the lamp, limiting its positioning in small fixtures. A second problem is that the heat lost in the electrode cooling is really energy lost from light production. The heat loss also lengthens the start-up time from ignition to the full on state. There is then a need for a lamp with a hot seal.

The residual volume surrounding the electrode assembly in the capillary acts as a reservoir for the fill materials. This reservoir can disproportionately hold or supply fill materials to the discharge or can provide a reaction zone generating undesirable compounds interacting with the discharge, the electrode assembly or the envelope wall. Salts which enter and leave the residual volume in an uncontrolled manner may cause to time varying color shifts. There is a need to reduce or eliminate the residual volume in the seal region of a discharge lamp, and thereby limit such effects.

Pure metals are generally more reactive than are the iodide salts commonly used in a high intensity discharge lamp, and would therefore normally cause problems with frit seal materials. It is an object of the invention to enable a seal tolerant of pure metal fills.

BRIEF SUMMARY OF THE INVENTION

A high intensity arc discharge lamp may be made with an envelope substantially formed from a ceramic material. The envelope has a wall defining an enclosed volume with an interior surface. The wall is formed with at least one passage extending from the interior surface of the enclosed volume to an exterior side of the wall. The lamp has at least a first electrically conductive electrode assembly extending into the enclosed volume, and electrically coupled to the exterior of the envelope through a seal plug having a metal seal portion hermetically sealed in the passage to close the passage without the use of a frit. The seal plug has a least operating temperature during normal operation in excess of 800 degrees Celsius. A chemical fill is located in the enclosed volume including one or more pure metals having vaporization between 800 degrees Celsius and 1000 degrees Celsius. The chemical fill does not include any non-metallic components chemically reactive with the metal seal portion at the temperature of normal lamp operation. An inert fill gas is used having a fill pressure greater than five kilopascals at 20 degrees Celsius.

DETAILED DESCRIPTION OF THE INVENTION

Figure 1:
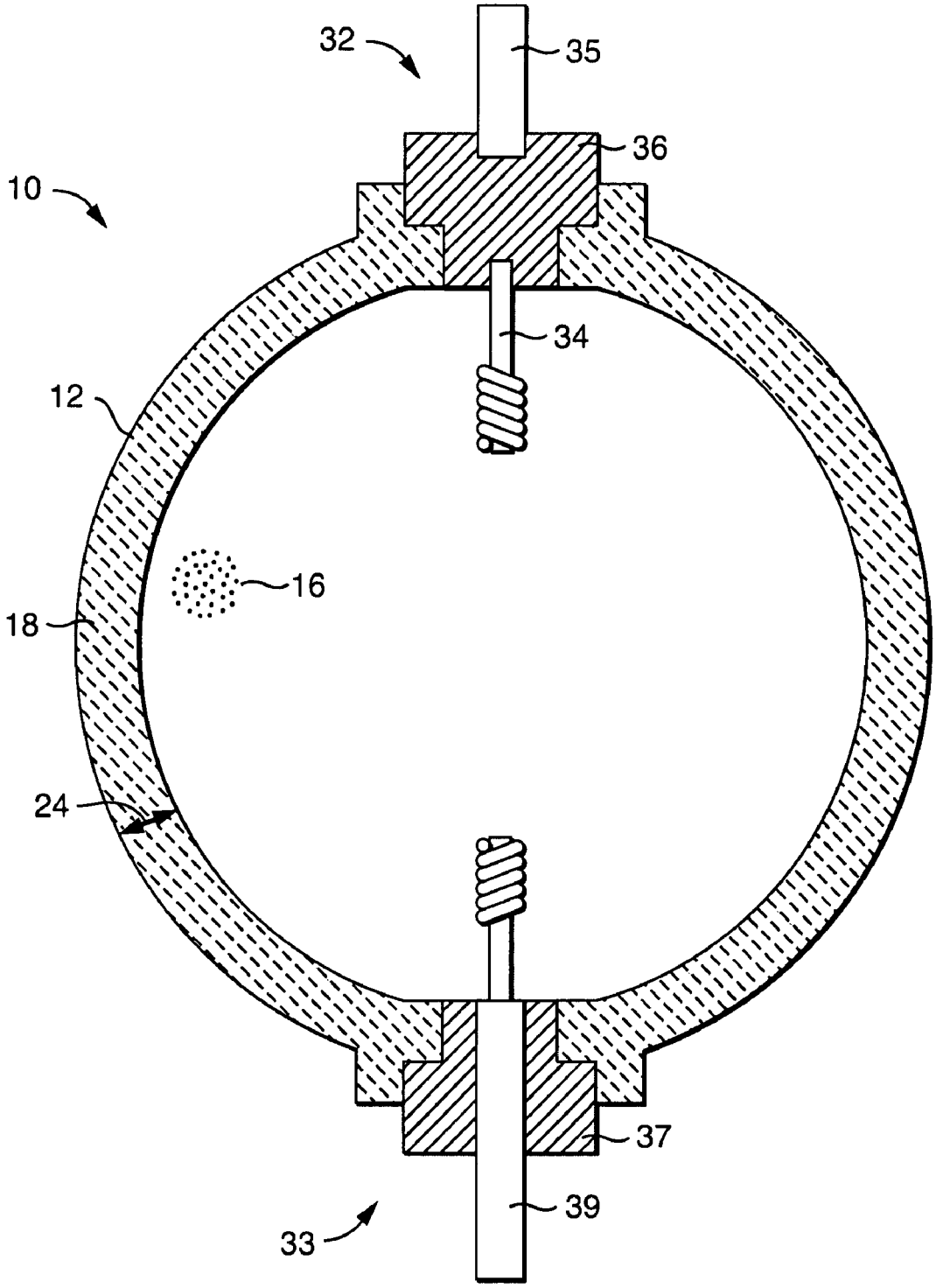
FIG. 1 shows a schematic cross sectional view of a high intensity discharge lamp.

FIG. 1 shows a schematic cross sectional view of a high intensity discharge lamp 10. The lamp 10 includes a ceramic envelope 12, one or more electrodes assemblies 32, 33 sealed in the envelope 12, a fill chemistry 16 and an inert fill gas.

Figure 2:
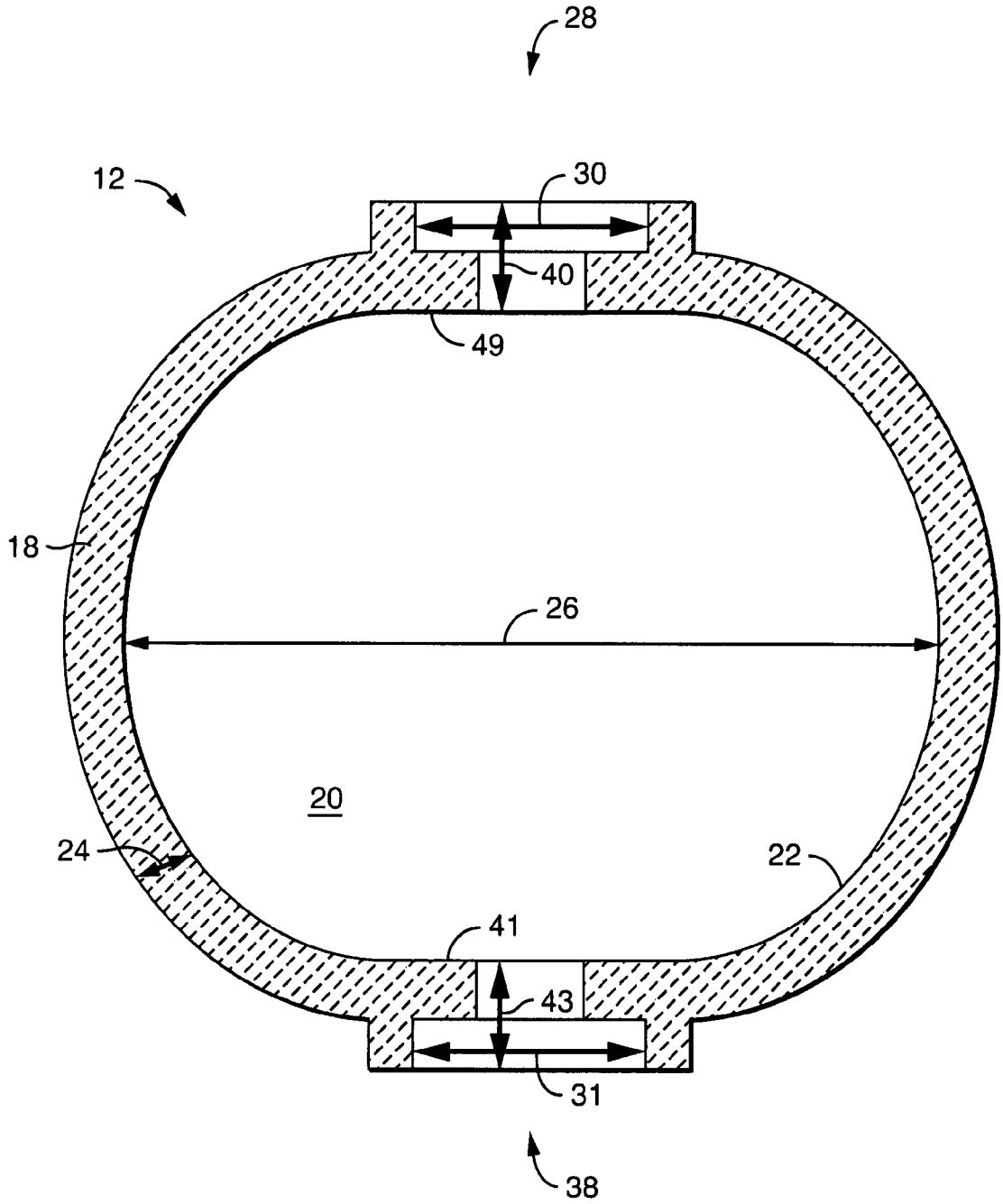
FIG. 2 shows a schematic cross sectional view of a high intensity discharge lamp envelope.

FIG. 2 shows a schematic cross sectional view of a high intensity discharge lamp envelope 12. The ceramic envelope 12 may be formed from a variety of ceramics. For purposes here, glass, hard glass, and quartz are not considered ceramics, while polycrystalline alumina, polycrystalline dysprosium, yttria, aluminum oxynitride, aluminum nitride and similar solid metal oxide and metal nitride materials (and mixtures thereof) are considered ceramics. The preferred ceramic is polycrystalline alumina (PCA). The chosen ceramic envelope 12 has a ceramic thermal coefficient of expansion that is used to match that of the seal portions 36, 37. The preferred envelope 12 has a wall 18 shaped to define a sphere like enclosed volume 20 with an inner surface 22. The preferred interior surface 22 is free of corners to be sphere like. A prolate sphere, oblate sphere, ellipsoid or similar internally rounded surface is acceptable. The corner free surface 22 is preferred so as to avoid cold spots that may form in a corner or crevice, as is the case with a cylindrical envelope. The wall 18 has an average thickness 24. The preferred wall thickness 24 is greater than or equal to 0.1 millimeter and less than or equal to 2.0 millimeters with a preferred thickness of about 0.9 millimeters. The Applicants have made walls with a thickness of 0.4 millimeter and can make thinner walls but lamp lifetime is shorter with thinner walls. Walls can be made thicker than 2.0 millimeters, but transmittance is reduced and the increased thermal mass of a thicker wall becomes a problem. The preferred enclosed volume 20 has an internal diameter 26 greater than 1.0 millimeter and less than or equal to 42.0 millimeters with a preferred value of 7.9 millimeters.

Figure 3:
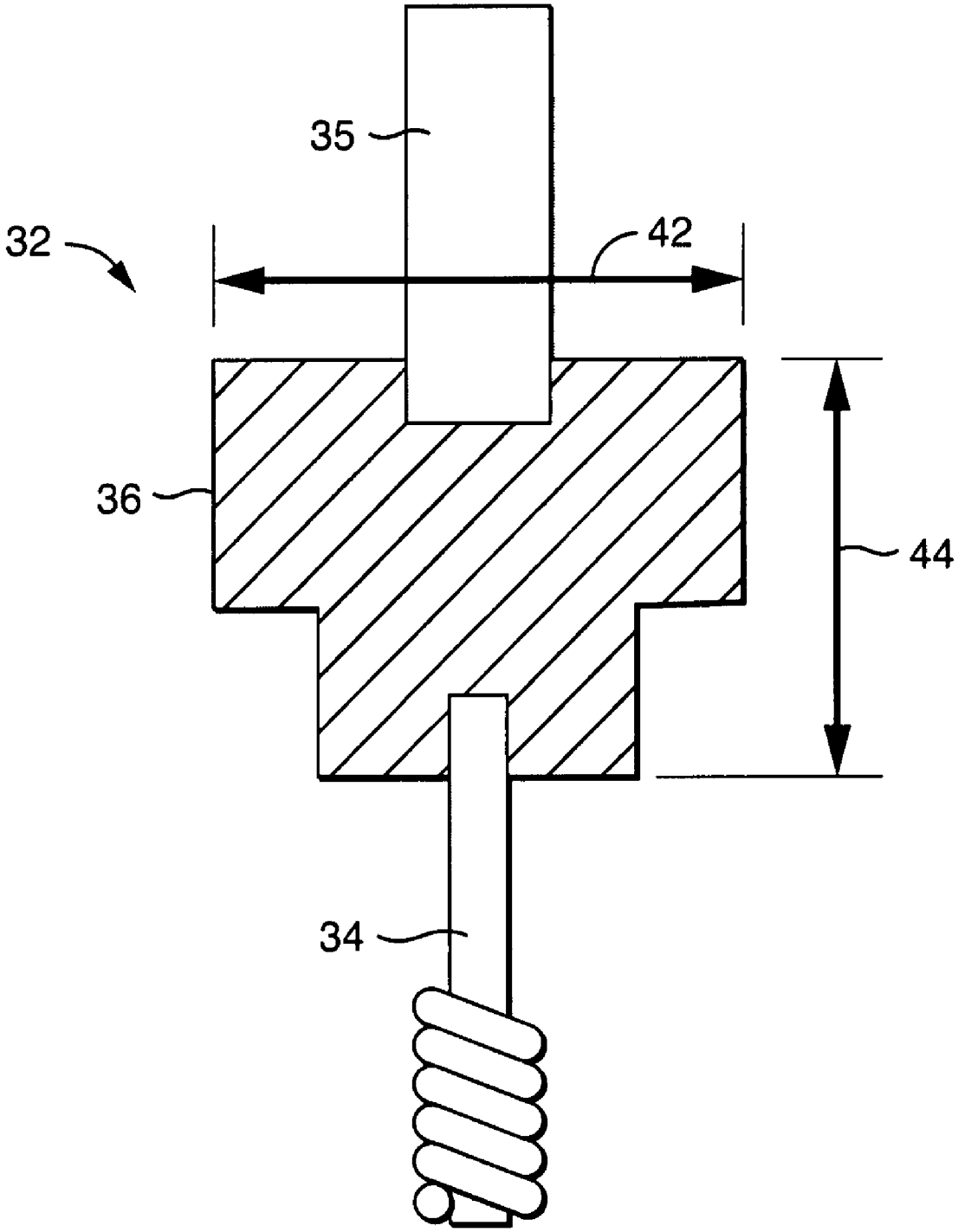
FIG. 3 shows a schematic cross sectional view of a first seal plug.

The wall 18 defines a first passage 28 and a similar second passage 38. The first passage 28 and second passage 38 extend from the lamp exterior to the enclosed volume 20. The first passage 28 has inside diameter 30 sized to form a compression fit with a metal seal plug 32. An interference seal may then be formed along passage 28 between a seal plug 32 and envelope ceramic (PCA). The preferred passages 28 and 38 are formed respectively with shoulders 41 and 49 to set respectively the axial insertion of the seal plugs 32, 33. The cold inside diameter 30 of the first passage 28 is from three to nine percent (3-9%) smaller than the corresponding cold outside diameter 42 of the seal portion 36 (FIG. 3). This is achieved during densification which occurs during the final sintering process (1850 degrees Celsius). The preferred passage 28 of the fully sintered PCA part has an inside diameter 30 that is seven percent (7%) smaller than the corresponding outside diameter 42 of the seal portion 36. The second passage 38 may be similarly formed and sealed. The cylindrical passage 28 has a length 40 which is greater than or equal to 0.8 times the average wall thickness 24 and less than or equal to two times the average wall thickness 24 with a preferred value of 1.11 times the average wall thickness 24. The second passage 38 has a similarly short axial length 43. The relatively short passages 28, 38 do not have capillary forms, and do not provide the same cooling gradient typical of a capillary seal. Rather, the passages 28, 38 have minimal axial lengths 40, 43. During lamp operation, the passages 28, 38 then have nearly isothermal temperatures due to the relatively short lengths 40, 43 and the intimate thermal contact with the metal seal plugs 32, 33.

FIG. 3 shows a schematic cross sectional view of a seal plug 32. The passage 28 is sealed with a seal plug 32 having an electrode 34 and a seal portion 36. The preferred seal portion 36 is a cylindrical body with a diameter 42, and a height 44. In one preferred embodiment, the diameter 42 and height 44 were approximately equal. Formed on an interior side may be an axially aligned blind hole to receive the electrode shaft 34. The electrode shaft 34 is typical of high intensity discharge lamps, and may be a tungsten shaft with any of the known end tip structures such as a wire wrap or other, and is extended axially for exposure in the enclosed volume 20. Once inserted in the blind hole, the shaft 34 is welded or similarly bonded to the seal portion 36. It is convenient to insert a similar lead 35 on the exterior side of the seal portion 36 to enable electrical or mechanical coupling to the lamp.

Figure 4:
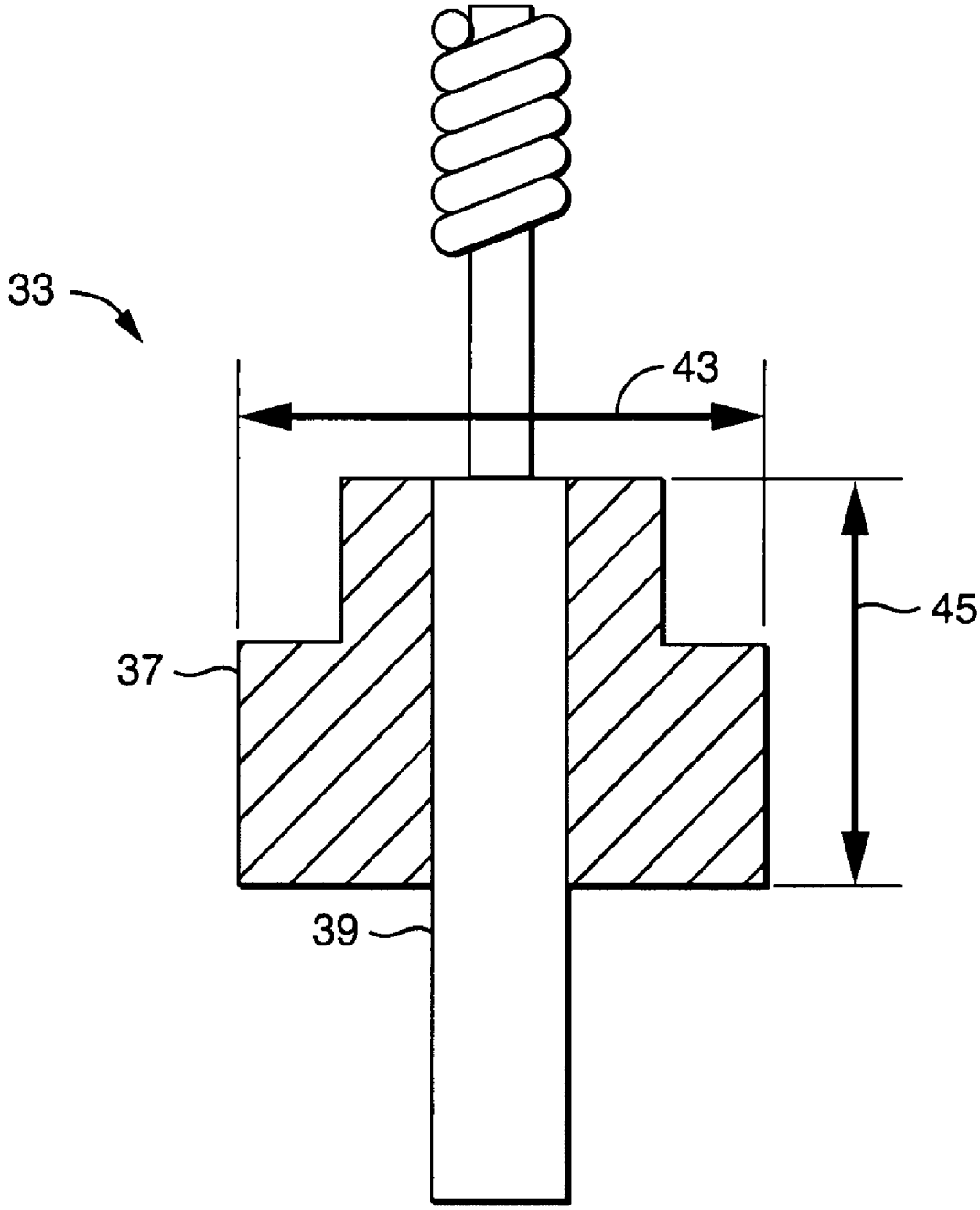
FIG. 4 shows a schematic cross sectional view of a second seal plug.

FIG. 4 shows a second seal electrode assemble 33 formed from a second seal portion 37 and a second electrode shaft 39. The sealed portion 37 may be a cylindrical body with a diameter 43 and a height 45. In one preferred embodiment the diameter 43 and height 45 were approximately equal. To fill the enclosed volume 20, a through passage is formed in the second seal portion 37. After the fill chemistry and fill gas are passed into the enclosed volume 20, the second seal portion 37 is closed by inserting the second electrode 39 into the through passage, and welding or similarly bonding to the second seal portion 37 and the second electrode 39. Again, the preferred electrode shaft 39 may be typical of high intensity discharge lamps and may be a tungsten shaft with any of the known end tip structures such as a wire wrap or other tip, and is extended axially for exposure in the enclosed volume 20. Electrode 39 may be held in place so that it does not shift position during welding by any of the well known means in the art, namely pinching, or scraping the shaft to slightly deform it creating a frictional surface interference, or welding a stop wire perpendicular to the electrode shank. The preferred inner shank portions are similar is size and shape and have similar wire wrapped ends. The preferred second electrode 39 is formed as a two piece shank with the inner shank starting at the inner surface of the seal portion and supporting a wire wrapped end. The inner shank and wire wrapped end have a sufficiently small combined outer diameter to pass through the seal portion passage so that they may be inserted through the seal portion passage to emerge into the enclosed volume.

The preferred seal portions 36, 37 are plugs with outside diameters 42, 43 sized to fit respectively the envelope passages 28, 38, all preferably being cylindrical. The seal portion diameters 42, 43 are chosen so that the fully sintered inner diameters 30, 31 (cold temperature) of the envelope passages 28, 38 are slightly smaller, say between 0.91 and 0.97 times the respective outer diameters 42, 43 of the seal portion 36, 37 with a preferred value of 0.94 times the seal portion's outer diameter 42, 43. The preferred seal portions 36, 37 have axial dimensions 44, 45 from the interior surface to the exterior side of the seal portion 36, 37 that are from one times the average wall thickness 24 to about four times the average wall thickness 24, and preferably are not more than two times the average wall thickness 24. The relatively thin seal portions 36, 37 then do not act as heat sinks, but are more likely to be maintained at a temperature at or above the average operating temperature of the surrounding envelope wall 18. The seal plugs 32, 33 are not capillary seals in that they are fritless, and axially thin so as to be approximately isothermal with the surrounding envelope.

The seal portions 36, 37 may be formed by blending two or more metal powders that are then pressed, sintered, hot isostatically pressed or otherwise densified. For example, one metal powder can have a higher expansion than the chosen ceramic and the other metal powder can have a lower expansion than the ceramic. With respect to alumina, the preferred ceramic, the first metal powder may be selected from the group including molybdenum and tungsten and alloys thereof, and the second metal powder may be selected from the group including chromium, titanium and vanadium and alloys thereof. The two metal powders are then blended to have a combined thermal coefficient of expansion closely matched to the ceramic thermal coefficient of expansion for the chosen ceramic envelope material. In particular, the metal powders are blended to have a thermal coefficient of expansion differing from the ceramic thermal coefficient of expansion by not more than plus or minus four percent.

Located in the enclosed volume 20 is a chemical fill 16 excitable to light emission on the application of electric power. The preferred chemical fill comprises one or more pure metals having a substantial vapor pressure at the operating temperature the seal plugs 32, 33 can sustain. The relatively hot seal plugs 32, 33 enable the use of fills including pure metals with substantial vaporizations above the typical frit melting temperature and below the sintering temperature of the ceramic envelope material. The preferred fill 20 includes individual pure metals or combinations of pure metals selected from the group including: barium, calcium, cesium, indium, lithium, mercury, potassium, sodium, thallium, and zinc. Other pure metals may be used to produce special light sources. For example other metals from the periodic table may be used from the groups including IA, IIA, VA, VIA, VIIA, VIIIA, IB, IIB, IIIB, IVB, VB and VIB so long as they do not react with the seal plug at the operating temperature. As an example, magnesium may be used but not sulfur which is expected to form metal sulfides. It is useful to use mercury as a voltage developing additive; however mercury may be unacceptable for some uses. It is a particular advantage of the present high temperature seal structure that pure zinc can be used in place of mercury to assist in developing lamp voltage. The fill combinations of zinc with one or more of the metals barium, calcium, cesium, indium, lithium, potassium, sodium and thallium are a preferred. The chemical fill 16 is chosen to exclude halogens, halogen compounds and other compounds that may chemically react with the metal seal portion 36 components at the temperature of normal lamp operation, about 1200 degrees Celsius. The use of pure metals while excluding halogens and other reactive compounds from the fill 16 prevents dissolution of the PCA into the chemical fill melt as in the prior art. As a result, internal corrosion of the envelope 12 is reduced.

The enclosed volume 20 also includes an inert fill gas. The preferred fill gas may be argon, krypton, or xenon or mixtures thereof. The fill pressure at 20 degrees Celsius may be in the range of 10 Pascals to 2 megapascals (20 atmospheres). The preferred fill gas pressure is about 60 kilopascals at 20 degrees Celsius. The preferred fill gas is xenon having a cold fill pressure greater than ten kilopascals (one tenth atmosphere).

In one embodiment the ceramic envelope was made from PCA, and had a thermal expansion coefficient of $8.3\times10^{-6}$ inverse degrees Celsius at 1000 degrees Celsius. A seal plug was made from a first component of 71.0 weight percent molybdenum. The second component was made 29.0 weight percent vanadium. Molybdenum powder (71.0%) was mixed with the vanadium (29.0%). The two component mixture was then pressed and sintered to greater than 95 percent density with closed porosity, and machined to form a cylindrical plug with a diameter of 2.0 millimeters, and had an axial length of 20.0 millimeters. The plug then had a thermal coefficient of expansion of approximately $8.3\times10^{-6}$ inverse degrees Celsius at 1000 degrees Celsius, nearly the same as that of the PCA. A tungsten shaft 0.68 millimeters in diameter and 2.2 millimeter long was welded onto an end of the seal plug. A ceramic bulgy envelope (roughly spheroidal having a rounded interior free of corners) was made from PCA with a thermal coefficient of expansion of $8.3\times10^{-6}$ inverse degrees Celsius at 1000 degrees Celsius, with a cylindrical passage with a sintered diameter to seal against the matched 2 millimeter diameter molybdenum vanadium plug. The plug is inserted into the cylindrical passage and the two pieces are then sintered together. A second passage was similarly formed and sealed with a similar plug and electrode. One preferred sealing process is to seal the first seal plug (32) and the second seal portion (37) in the respective passages of the envelope. The fill 16 is then introduced through the open passage in the second seal portion (37). The assembly is placed in a pressure vessel having a laser window and pressurized with the selected inert fill gas (argon, xenon, etc.) to the desired cold fill pressure. The electrode shaft (39) is inserted in the second seal portion (37). A laser beam is shown through the window to weld the second seal portion (37) and the electrode shaft (39), sealing the enclosed volume. A preferred fill is sodium, thallium, indium and mercury with a fill gas of xenon at a cold pressure of approximately 50 kilopascals. In one embodiment, the fill comprised a combination of approximately 6.64 molar percent indium, 49.64 molar percent sodium, 38.06 molar percent mercury, and 5.65 molar percent thallium. The lamp had an external equatorial diameter of 9.7 millimeters and external axial length of 12.6 millimeters. The electrode ends had axial extensions of 2.0 millimeters from the main body of the envelope (the internal plug surface to electrode tip), and had diameters of 0.25 millimeters. The lamp was operated at a temperature of more than 1000 degrees Celsius.

Figure 5:
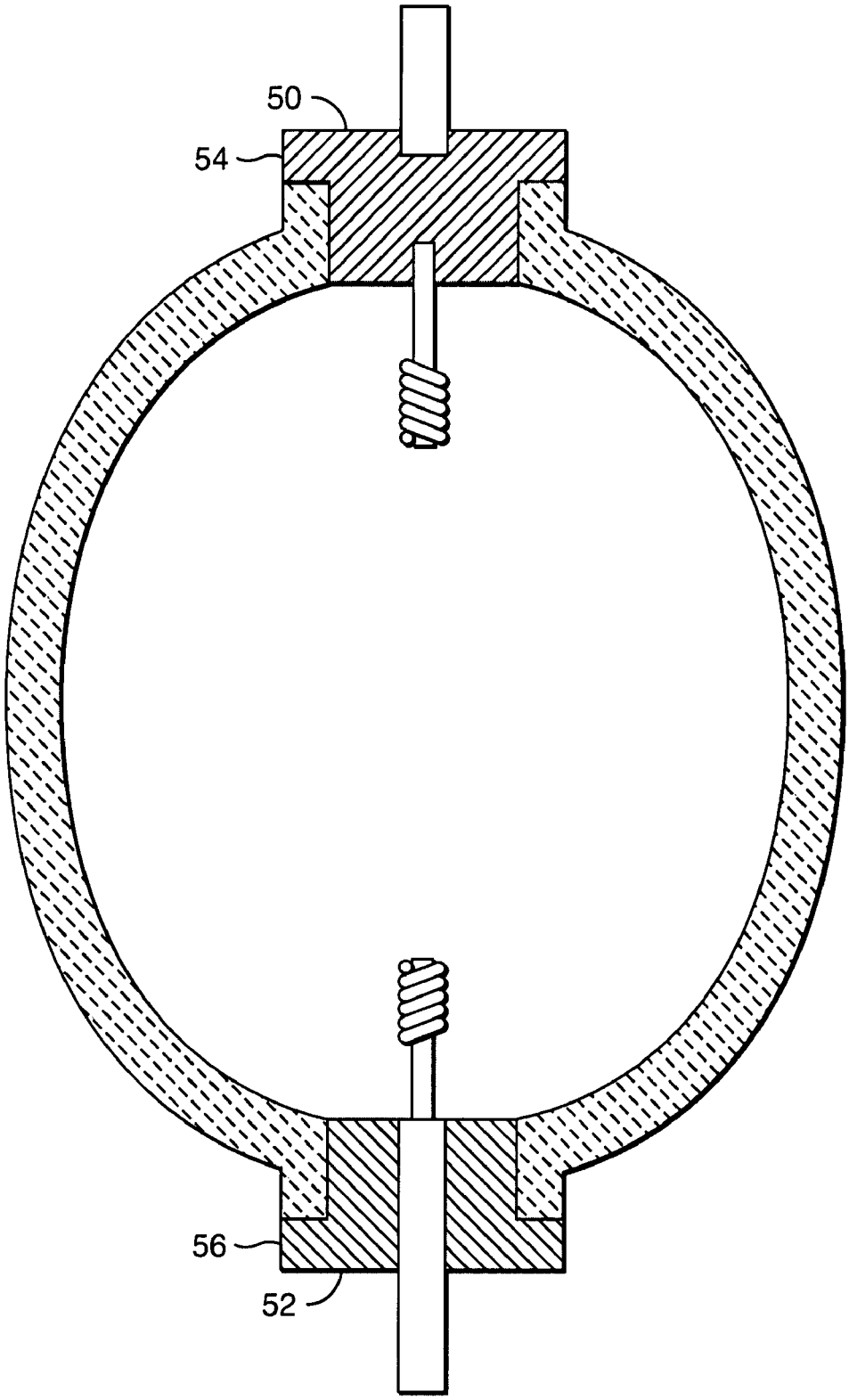
FIGS. 5 to 8 show cross sectional views of alternative high intensity discharge lamps.
Figure 6:
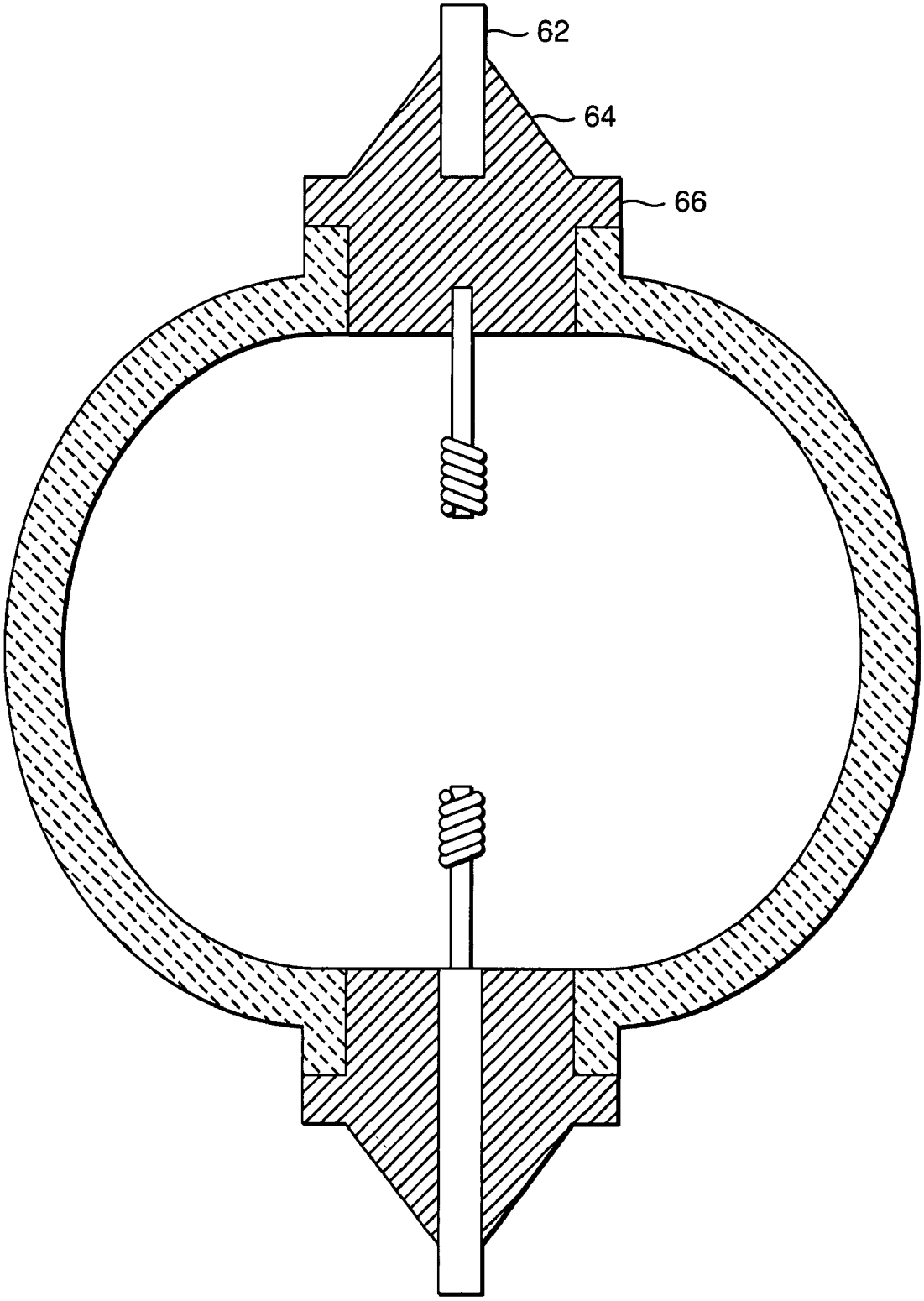
Figure 7:
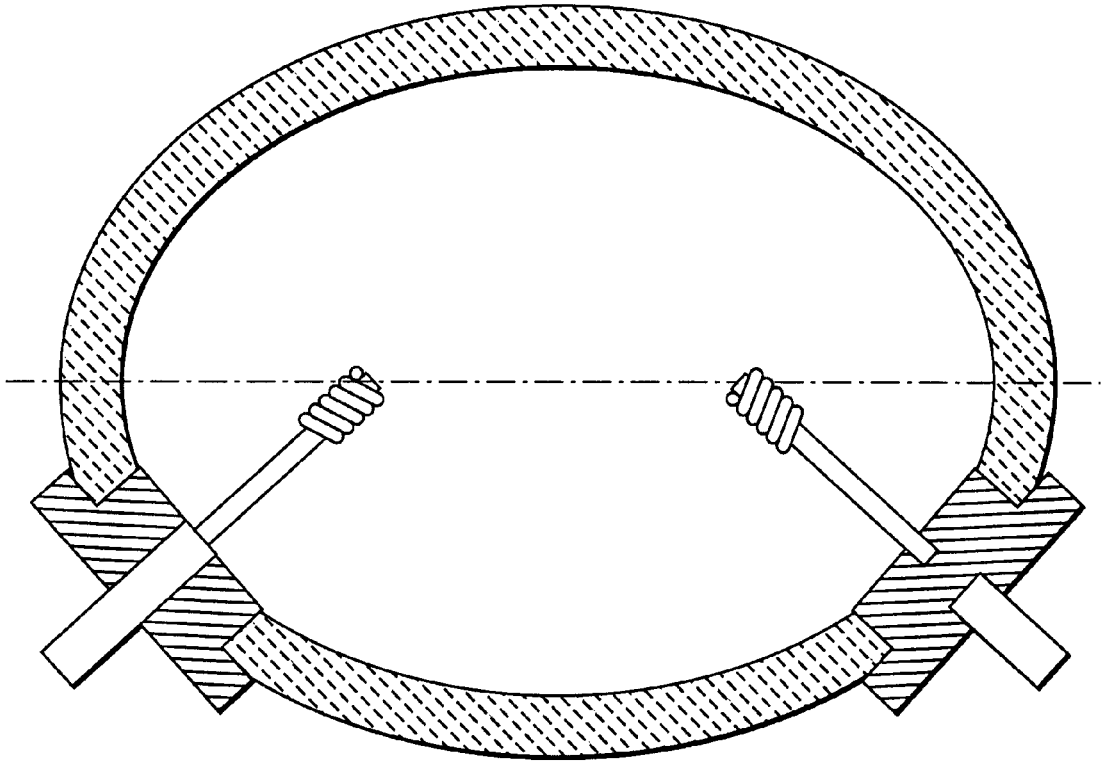
Figure 8:
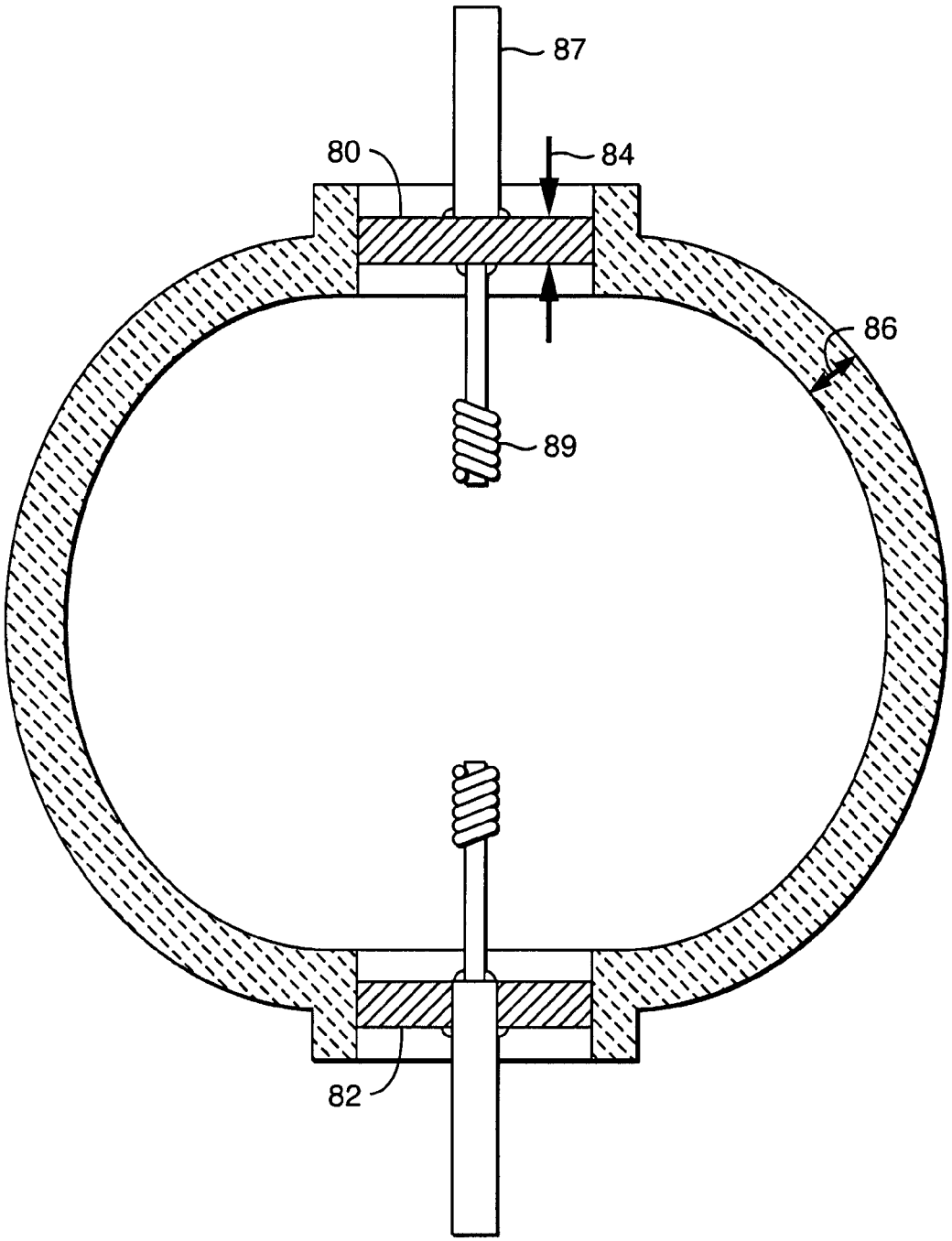

FIGS. 5 to 8 show cross sectional views of alternative high intensity arc discharge lamps. FIG. 5 shows a cross sectional view of an alternative high intensity arc discharge lamp with axially aligned seal plugs 50, 52 each having a stepped flange 54, 56 to seal with the end of the respective cylindrical passages. The T or "top hat" shaped plugs assist in assembling and locating the plug in the lamp envelope body. FIG. 6 shows a cross sectional view of an alternative high intensity arc discharge lamp with an electrode similar to the configuration in FIG. 5 wherein the electrode shaft 62 is extended through the seal plug 64. The seal plug 64 is sloped up from the stepped flange 66 along electrode shaft 62 to extend the sealing junction. The "tapered top hat" of FIG. 6 facilitates welding the thinned tapered region for a taper weld as opposed to a fillet weld as in FIGS. 1 and 5. FIG. 7 shows a cross sectional view of an alternative high intensity discharge lamp with plug seals 70, 72. The plug seals 70, 72 are offset from the major envelope axis and the electrode shafts 74, 76 are angled to the major envelope axis, albeit the electrode shaft tips are approximately on the major envelope axis. FIG. 7 shows both passages do not have to be diametrically opposed. Rather, the electrodes can be at the same latitude in the envelope, and not just at the pole positions. FIG. 8 shows a cross sectional view of an alternative high intensity arc discharge lamp with plug seals 80, 82 wherein the plug seals 80, 82 have an axial thickness 84 less then the envelope wall thickness 86. The first electrode sections 87, 89 instead of being held in blind holes may be welded directly to the respective faces of the plug seal 80. FIG. 8 shows an embodiment where the thickness of the plug 80 is less than the diameter, having an aspect ratio more like a "coin." This is economically attractive as it uses less of the blended metal material, such as the molybdenum-vanadium material.

It is important to elevate the lamp seal temperature during normal operation to enable the vaporization of the preferred fill materials, and avoid fill condensation or fill sequestration in or around the seal area. To elevate the seal temperature, the respective seals between the passages 28, 38 and the seal portions 36, 37 are not formed with a frit. Frits are known glassy materials with numerous compositions, used to melt seal an interface between a ceramic envelope and metal electrode. Frits have melting points, typically about 1600 degrees Celsius, which are less than the ceramic envelope sintering temperature, and less than the metal electrode softening point. Frits may still chemically react with lamp fill materials at relatively low temperatures, for example less than 780 degrees Celsius, and to reduce such reaction and retain their mechanical sealing feature, frits are commonly kept at a temperature below their melting point. This is achieved in a capillary seal by placing the frit at the exterior (cooler) end of the capillary. In capillary type lamps, the capillary or the adjacent region then becomes or includes the cold spot of the lamp. The cold spot temperature is a significant driver in determining the condensation behavior of the lamp. The frit materials used in capillary seals can only tolerate about 780 degrees Celsius, and that temperature then sets what is vaporizable in the envelope of a capillary style lamp. In the present structure, the seals have no frit, and can therefore tolerate a higher operating temperature. The regions of the seal plugs 32, 33 can then become nearly as hot, if not hotter than the remaining lamp body, thereby pushing the cold spot temperature over 1000 degrees Celsius. This is unlike the case of a conventional capillary lamp where the hot spot is typically along the lamp body, and the capillary region is relatively cooler, if not the cold spot.

It is a novel and useful feature of the present structure that the seal region (the region of the envelope wall 18 and seal plug 32 joint) can be operated at an elevated temperature so as to force the fill chemistry into the high temperature enclosed volume zone. The hot seal plug enables the fill to include materials vaporizable at temperatures above the typical frit temperature limitation. For example, pure metals can now be vaporized at the higher temperature and contribute their respective light emissions to the arc spectrum. In operation, the cylindrical region surrounding the seal plug typically runs hotter by 50 to 100 degrees Celsius, than the equatorial region of the lamp envelope. Operated at 40 watts, one lamp constructed as shown in FIG. 1 showed the cylindrical seal region to be operating with a temperature of 1039 degrees Celsius with less than a 5 degree Celsius variation over the seal plug region while the equatorial envelope region was operating at a temperature of 973 degrees Celsius. This was a temperature gradient along the body of approximately 66 degrees over a distance of 5.8 millimeters or about 11.3 degrees Celsius per millimeter measured from the interior junction point between the envelope and the plug to the equator of the envelope. It is expected that the temperature measurement at the weld joint between the envelope wall and the seal plug on the inside of the lamp is hotter.

In the present structure, frits are eliminated from the seal, enabling the use of higher temperature fill materials, and the more corrosive pure metal fill materials. With a higher operating temperature, less fill material is needed to achieve the same pressure. With a higher operating temperature, more efficient light production may be achieved. While there have been shown and described what are at present considered to be the preferred embodiments of the invention, it will be apparent to those skilled in the art that various changes and modifications can be made herein without departing from the scope of the invention defined by the appended claims.

What is claimed is:

1. A high intensity discharge lamp comprising:

an envelope substantially formed of a ceramic material; the envelope having a wall defining an enclosed volume with an interior surface; the wall formed with at least one passage extending from the interior surface of the enclosed volume to an exterior side of the wall;

at least a first electrically conductive electrode extending into the enclosed volume and electrically coupled through a seal plug having a metal seal portion that is hermetically sealed in the passage to close the passage without the use of a frit;

a chemical fill located in the enclosed volume, the chemical fill consisting of sodium metal, thallium metal, indium metal and mercury metal; and an inert gas in the enclosed envelope, the inert gas having a fill pressure greater than five kilopascals at 20 degrees Celsius.

2. The lamp of claim 1, wherein the ceramic material is polycrystalline alumina.

3. The lamp of claim 2 wherein the metal seal portion is comprised of a first metal selected from tungsten and molybdenum and alloys thereof, and a second metal selected from chromium, titanium, vanadium and alloys thereof.

4. The lamp of claim 1 wherein the inert gas is xenon.

5. The lamp of claim 1 wherein the fill is 6.64 molar percent indium, 49.64 molar percent sodium, 38.06 molar percent mercury and 5.65 molar percent thallium.

* * * * *